United States Patent [19]

Reimert

[11] 4,408,784

[45] Oct. 11, 1983

[54] PRODUCTION CASING TIEBACK CONNECTOR ASSEMBLY

[75] Inventor: Larry E. Reimert, Thousand Oaks, Calif.

[73] Assignee: Vetco, Inc., Calif.

[21] Appl. No.: 241,187

[22] Filed: Mar. 6, 1981

[51] Int. Cl.[3] ..... F16L 55/00

[52] U.S. Cl. ..... 285/24; 285/143

[58] Field of Search ..... 285/27, 24, 143, 142, 285/140

[56] References Cited

U.S. PATENT DOCUMENTS

| | | | |
|---|---|---|---|
| 2,122,071 | 6/1938 | Rasmussen et al. | 285/143 X |
| 2,768,841 | 10/1956 | Allen | 285/143 X |
| 3,330,341 | 7/1967 | Jackson, Jr. et al. | 285/142 X |
| 3,347,567 | 10/1967 | Watkins | 285/24 |
| 3,924,679 | 12/1975 | Jansen, Jr. | 285/142 X |

*Primary Examiner*—Thomas F. Callaghan

*Attorney, Agent, or Firm*—Edward L. Kochey, Jr.

[57] ABSTRACT

A connector assembly for connecting a production casing (38) to a subsea wellhead (10) from a tensioned leg platform. A funnel (46) external to the wellhead, guides and aligns the conductor during installation and places a limit on the angular deflection of the conductor relative to the wellhead. The conductor includes at its lower end a tieback joint (44) which is pulled down, aligned, and sealed against the casing hanger (24) with a floating bushing (64) which also preloads the seal (66). The flexibility of the tieback joint (44) in relation to the angular deflection permitted is such that the surfaces of the seal (66) will not move; and preferably the preload on the seal is not removed.

11 Claims, 2 Drawing Figures

PRODUCTION CASING TIEBACK CONNECTOR ASSEMBLY

BACKGROUND OF THE INVENTION

The invention relates to oil production from the seafloor to a tensioned leg platform and in particular to a connector assembly for tying back the production casing from the seafloor to the TLP wellhead.

Offshore oil wells may be drilled from a floating platform and therafter produced to a later-installed tensioned leg platform. Such a procedure requires the running of casing strings from the platform deck to the seafloor wellhead. Tubing is then run, surface production trees installed, and the well is produced in a conventional manner.

When running a conductor and attaching it to the wellhead, axial alignment between the wellhead and the conductor is a problem. A solution for this is described in co-pending application Ser. No. 120,200, filed Feb. 11, 1980, now Patent No. 4,343,495. A downwardly-extending funnel with two bearing surfaces surrounds the wellhead and achieves the angular alignment. Final alignment is achieved when the connector is brought into abutting relationship with the upper edge of the wellhead where the seal is effected. For production to be to a fixed platform, there would be no additional motion once the connection has been made. A tensioned leg platform, however, introduces movement of the upper end of the riser. Accordingly, a large diameter conductor experiences excessive strains and stresses for a given deflection. A smaller diameter production riser is preferable since this results in lower stresses for a given offset movement.

Even with the smaller conductor, however, there are repeated and varying bending moments placed on the wellhead connection during normal operation. This will cause unloading, or even movement, of the seal and a loss of pressure integrity thereof. Accordingly, an apparatus is to be preferred which will avoid failure of the seal caused by the deflection of the production riser.

SUMMARY OF THE INVENTION

A connector assembly for tying back a subsea wellhead to a tensioned leg platform includes a casing hanger which is supported and sealed within the wellhead. The connector itself which is secured to the production casing includes both a tieback joint and a guiding means for limiting deflection. The tieback joint is a vertically elongated hollow cylinder which is rigidly connected at its upper end to the guiding means. The lower portion of this cylinder fits within the wellhead and has a sealing surface whereby a seal may be employed to effect a seal together with a sealing surface on the casing hanger. The guiding means includes a downwardly-extending funnel which surrounds the wellhead and interacts with the outer surface of the wellhead at an upper and lower elevation so as to limit the angular deflection of the tieback joint with respect to the wellhead. Means are also included for axially preloading the seal.

The angular deflection permitted by the guiding means and the flexibility of the tieback joint is such that the bending moment transmitted on movement of the production riser does not cause movement of the sealing surfaces or preferably even loss of preloading on the seal.

The joint is secured and the seal axially preloaded by the use of internal threads on the casing hanger below the sealing surface and a torque sleeve with external threads engaging these internal threads. The torque sleeve has a downwardly-facing shoulder which engages an upwardly-facing shoulder on the tieback joint so that the joint may be torqued down to effect the required preload. An abutment surface at the top of the casing hanger and at the bottom of the tieback joint limits the movement to compress the seal.

DESCRIPTION OF THE PREFERRED EMBODIMENT

Figure 1:
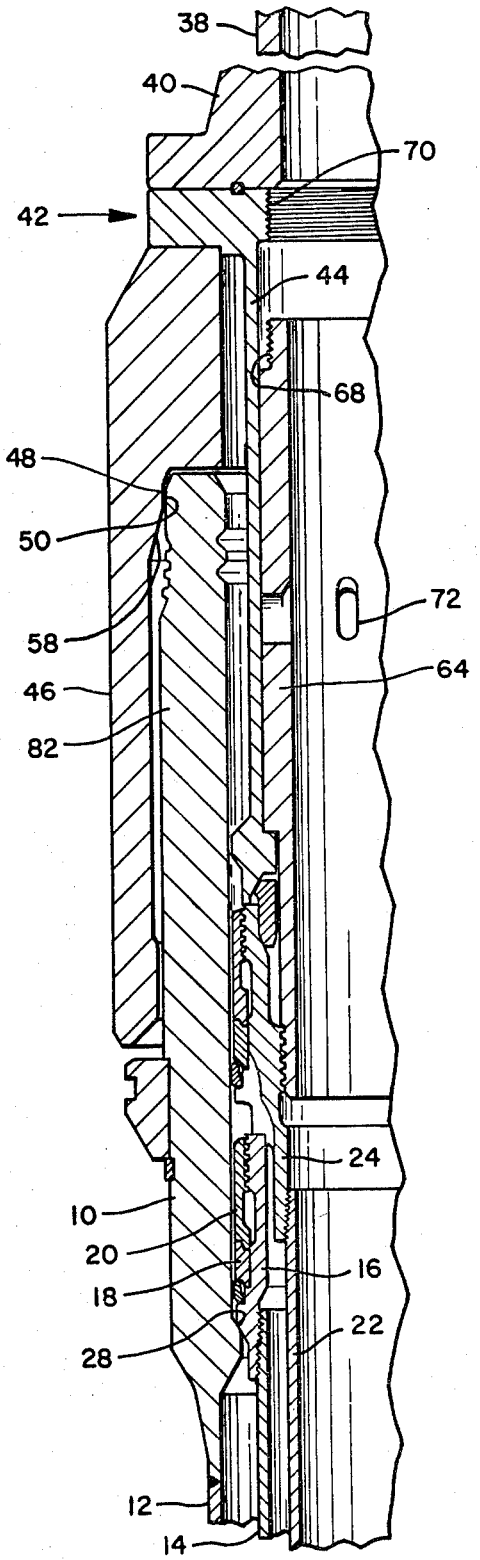
FIG. 1 is a sectional side elevation through a connector assembly, with a portion of the wellhead.
Figure 2:
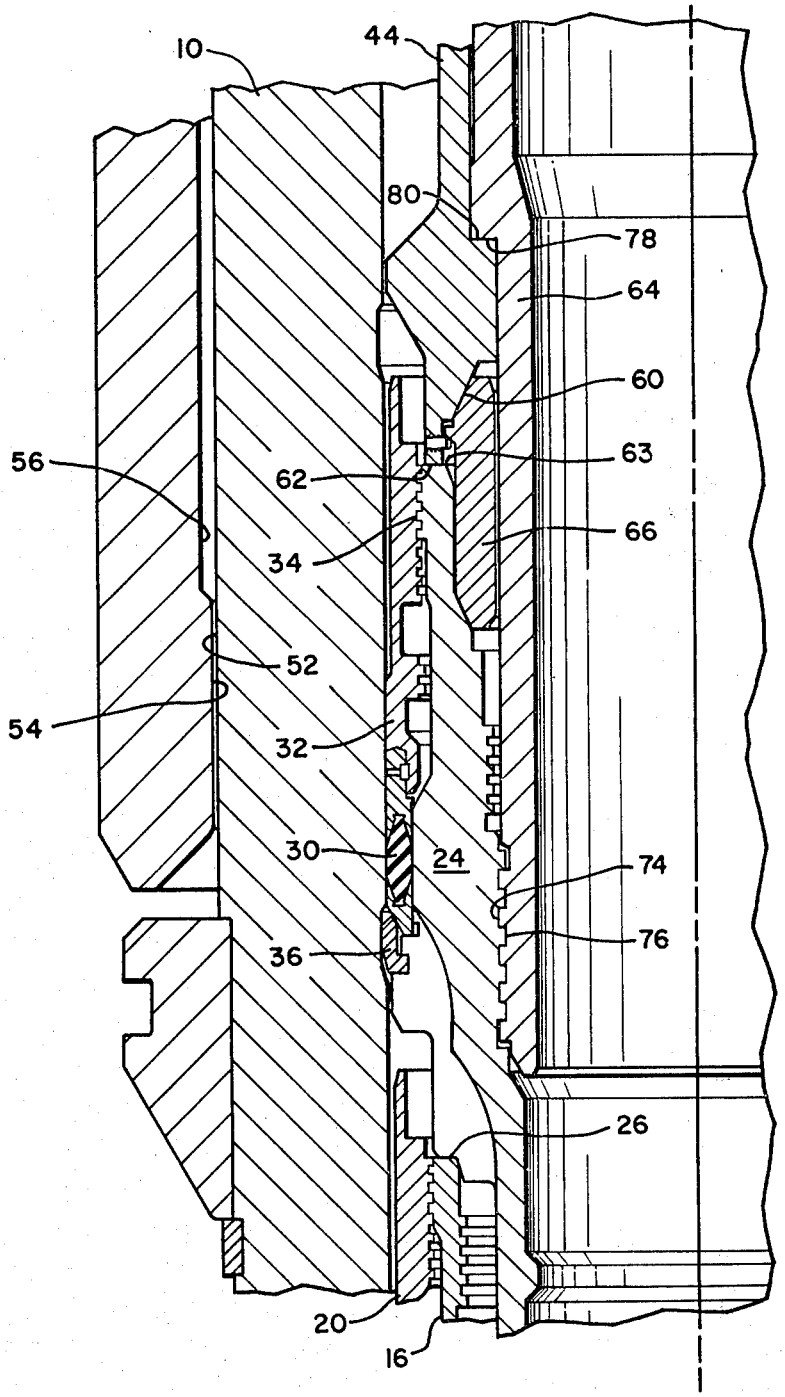
FIG. 2 is a detail of the seal area.

In accordance with standard practice in drilling subsea wells, a wellhead 10 is rigidly secured to an outer 50 cm casing 12 and through it secured to the seabed. Within the 50 cm casing there is supported a 34 cm casing 14 by casing hanger 16. Seal 18 energized by packoff nut 20, effects the seal between the 34 cm casing string and the wellhead.

A 25 cm casing string 22 is supported from an upper casing hanger 24. This 25 cm casing hanger rests on surface 26 of the 34 cm casing hanger. The 34 cm casing hanger in turn is supported and located on shoulder 28 of the wellhead. Since this shoulder is machined into the wellhead, the precise location of each of the casing hangers is known, subjected to manufacturing tolerances of the components.

An additional seal 30 energized by packoff nut 32 effects the seal between the 25 cm casing hanger 24 and the wellhead 10. The packoff energizes this seal by relative rotation of screw threads 34 external of the casing hanger so that the packoff nut 32 exerts a downward force on this seal. Lockdown ring 36 prevents any possibility of upward movement of the casing hanger.

Accordingly, the inner 25 cm casing string 22 is sealed to the wellhead, with the problem remaining of connecting this casing string to a tensioned leg platform located at the surface of the water throughout a limited range of locations. Because of the range of platform locations and the concomitant movement of the riser, the major and central portion of the casing string conductor 38 is of 25 cm outside diameter. This use of the restricted diameter reduces the stress for a given movement of the platform and also reduces the bending moments imposed at the platform and on the wellhead. The lower portion 40 of the conductor 38 is tapered to a larger outside diameter to stiffen the portion of the conductor immediately above the wellhead. A flanged connection is provided to establish a strong and rigid connection between the conductor and the wellhead connector 42.

The connector 42 includes a tieback joint 44 rigidly attached to a downwardly-extending funnel 46. The wellhead 10 has an upper bearing surface 48 with the funnel having an upper bearing surface 50 of a diameter only slightly larger than that of the wellhead bearing surface. The wellhead also has a lower bearing surface 52 with a corresponding lower bearing surface 54 on the funnel. The inner surface 56 of the funnel between the two bearing surfaces is of larger inside diameter with a sloped surface 58 located immediately below the upper bearing surface.

The funnel may also include downwardly-extending funnel means (not shown) at the lower end to aid in the initial guidance.

As the conductor with the connector is lowered toward the wellhead, the lower bearing surface 54 fits over the wellhead despite some angular misalignment. As it slides downwardly over the wellhead, the sloped surface 58 forces the conductor into alignment, until finally alignment is achieved with the interaction between bearing surfaces 48 and 50 at the top and bearing surfaces 52 and 54 at the bottom.

More importantly, funnel 46 is a guiding means which operates to limit the angular deflection to itself and the rigidly-attached tieback joint 44 with respect to the wellhead. As the moving tensioned leg platform causes the upper end of the conductor 38 to move horizontally, the tendency for horizontal movement and bending occurs at the wellhead. This is initially limited by the interaction between the funnel surface 50 and the wellhead surface 48. As a limit on further bending around this contact point, the lower funnel surface 54 abuts the lower wellhead surface 52, thereby limiting rotation of the wellhead connector 42. Further resistance of the bending moment depends on the strength of the wellhead 10. It can be seen that the limitation on angular deflection through the interaction of the funnel with the wellhead is a function of the clearances left between the discussed abutting surfaces. The clearance between the upper surfaces 48 and 50 is the most critial. Only enough clearance should be left between the inside diameter of the funnel and the outside diameter of the wellhead at this upper location to assure the funnel fitting over the wellhead. Eight-tenths of a millimeter on a diameter is reasonable. The diametral clearance between the lower surfaces 52 and 54 is also important but not as critical as that above. A similar diametral clearance, however, of about 0.8 millimeters is also considered satisfactory.

The tieback joint 44 is a vertically-elongated, hollow cylinder rigidly connecting at its upper end to the funnel or guiding means 46. The outside diameter of the lower portion of this joint is less than the ID of the wellhead so that it fits therewithin with a sealing surface 60 near its lower end. An abutting surface 62 is in contact with an abutting surface 63 at the upper edge of the hanger 24 when the tieback joint 44 is completely tightened down.

A bushing or torque sleeve 64 provides a means for tightening down the tieback joint 44 and axially preloading the seal 66. This bushing has external threads 68 at its upper end which are engageable in threads 70 located in the wellhead connector 42. These threads hold the bushing in a raised position while running the conductor downwardly from the platform.

After running the conductor so that engagement between the funnel and the wellhead is effected, the bushing is rotated by means of a tool lowered down through the conductor and engaging in slots 72. The bushing 64 then drops into a floating position and upon further rotation the external threads 74 on the lower end of the bushing 64 engage internal threads 76 on the casing hanger 24. Upon further rotation of the bushing, the downwardly-facing shoulder 78 on the bushing engages an upwardly-facing shoulder 80 on the tieback joint. This draws the connector down until the lower abutment surface 62 contacts the upper abutment surface 63 of the casing hanger. During this operation, the seal 66 is preloaded with the spacing of the components being such that proper preloading is accomplished with the given physical movement. The compression forces applied through torquing bushing 64 exceed those required to preload the seal for reasons discussed below.

If it were not for the limitation on deflection established by the interaction between the guide funnel and the wellhead, any movement of the upper end of the conductor 38 would place the full bending movement on the joint at seal 66. This would cause relaxation of the prelead on the tension side of the joint and possibly even cause movement and separation of the seal. With some types of seal, loss of preload would produce a potential leakage condition; and rubbing of the seal surface would deteriorate the surface.

With the funnel limiting the angular deflection permitted, a lesser bending moment is transmitted to the seal. The upper end of the tieback joint moves to the extent permitted and rotates to the limited angle from the centerline of the wellhead. This movement causes the bending moment to be transmitted back to the seal located which is a function of the stiffness of the tieback joint 44 in bending. The amount of bending moment transmitted is reduced where the length of the tieback joint is long, its diameter small, and its wall thickness small. Accordingly, the flexibility of the tieback joint should be such that with the given limited deflection, the bending moment transmitted to the seal location will not cause loss of preload on the seal. The axial load set in the joint when the bushing 64 is tightened down should be sufficient to supply the preload of the seal plus resisting of the bending moment due to this limited deflection as well as any vertical forces which may be placed on the production conductor be the tensioner from the platform.

Where the seal does not lose its effectiveness by loss of preload, the relationship between the permitted deflection and the flexibility of the tieback joint should be such that there is no movement of the sealing surfaces relative to the seal.

The actual elevation of the funnel with respect to the wellhead may vary slightly from predicted because of the accumulated tolerances between the lower casing hanger support 28 through the various components up to the funnel 48. Accordingly, the upper interacting surfaces 48 and 50 in particular and also the lower interacting surfaces 52 and 54 should be vertical. This provides the maintenance of the constant clearance despite some variations in the relative elevations of the two components.

In order to maintain the close tolerance at the upper point of interaction on the wellhead while still maintaining ease in lowering the funnel over the wellhead, the outside diameter of the wellhead at the upper surface 48 should be somewhat less than the nominal diameter of the wellhead and its central body 82.

It can be seen that a seal and rigid structural joint has now been effected between the casing hanger and the conductor string. The preload on the joint is greater than that required for the seal, and the flexibility of the tieback joint 44 limits the amount of bending movement transmitted to the seal location for a fixed axial deflection at the upper end of the tieback joint. This angular deflection is in itself limited by the interaction between the wellhead and the guiding means or funnel 46. Accordingly, a sealed connection is achieved which permits the movement of the tensioned leg platform to occur without damage of the seal to the casing hanger.

I claim:

1. A connector assembly for tying back a subsea wellhead to a tensioned leg platform comprising: a casing hanger supported and sealed within the wellhead, said hanger having a sealing surface; a connector comprising a tieback joint and a guiding means for limiting deflection; said tieback joint comprising a vertically elongated hollow cylinder rigidly connected at its upper end to said guiding means, the lower portion of said cylinder having an outside diameter less than the inside diameter of the wellhead, and having a sealing surface; said guiding means comprising means interacting with the wellhead for limiting angular deflection of said tieback joint with respect to the wellhead; a circumferential seal located between the sealing surfaces of said casing hanger and said tieback joint; and means for axially preloading said seal between said casing hanger and said tieback joint.

2. An apparatus as in claim 1: said casing hanger having internal threads at an elevation below said sealing surfaces; said tieback joint having an internal upwardly-facing shoulder; said means for axially preloading said seal comprising a torque sleeve having an external downwardly-facing shoulder adapted to mate with said upwardly-facing shoulder, and external threads for engaging said internal threads.

3. An apparatus as in claim 2 wherein: said sealing surface of said tieback joint is located near the lower end thereof.

4. An apparatus as in claim 3: said casing hanger having an abutment surface at an upper end; said tieback joint having an abutment surface at the lower end; said means for axially preloading said seal having the external threads and the external shoulder spaced so as to bring the abutment surfaces of said casing hanger and said tieback joint into abutment relationship after engagement of the external and internal threads.

5. An apparatus as in claim 4 wherein: said casing hanger has the sealing surface located inside said hanger near the upper end thereof.

6. An apparatus as in claim 5 wherein: the sealing surface of said tieback joint comprises an outwardly sloping downwardly surface; the sealing surface inside said hanger comprises an outwardly sloping upwardly surface; and said seal comprises a cylindrical metallic ring having upper and lower sealing surfaces on its outer periphery for mating with the sealing surfaces on said tieback joint and hanger respectively.

7. An apparatus as in claim 1 wherein said guiding means comprises: an annular structure having a first surface for abutting said wellhead at an upper elevation with a diameter close to that of the surface of said wellhead to be abutted, and a second inwardly-facing surface for abutting said wellhead at the lower elevation with the inside diameter of the surface being only slightly greater than the outside diameter of said wellhead at the elevaton to be abutted.

8. An apparatus as in claim 7 wherein: said annular structure is a downwardly-extending funnel, and said first surface for abutting said wellhead is an inwardly-facing surface with an inside diameter close to the outside diameter of said wellhead at the elevation to be abutted.

9. An apparatus as in claim 8 wherein: said first surface and the abutting surface of the wellhead are vertical, whereby the same clearance is maintained between the abutting surfaces through slight elevation differences.

10. An apparatus as in any one of claims 1 through 9 wherein: the annular deflection permitted by said guiding means and the flexibility of said tieback joint are so related that the bending moment transmitted to said means for axially preloading does not cause movement of said sealing surfaces relative to said seal.

11. An apparatus as in claim 10 wherein: the moment transmitted does not cause loss of preloading on said seal.

* * * * *